United States Patent [19]

Garcia

[11] Patent Number: 4,869,153

[45] Date of Patent: Sep. 26, 1989

[54] MECHANISM FOR FASTENING THE BARREL IN A MORTAR UNIT

[75] Inventor: Jose G. Garcia, Vizcaya, Spain

[73] Assignee: Esperanza y Cia., S.A., Spain

[21] Appl. No.: 123,175

[22] Filed: Nov. 20, 1987

[51] Int. Cl.[4] ..... F41F 23/26

[52] U.S. Cl. ..... 89/37.05; 42/75.02

[58] Field of Search ..... 89/87.05, 1.35; 42/75.02; 285/252, 253

[56] References Cited

U.S. PATENT DOCUMENTS

| | | | |
|---|---|---|---|
| 1,580,968 | 4/1926 | Di Brazza | 42/75.02 |
| 2,046,518 | 7/1936 | Joyce | 89/37.05 |
| 2,368,966 | 2/1945 | Brandt | 89/37.05 |
| 3,389,442 | 6/1968 | Tetzlaff | 285/252 |
| 3,407,449 | 10/1968 | Tetzlaff et al. | 285/253 |
| 4,282,671 | 8/1981 | Wood et al. | 42/75.04 |
| 4,328,633 | 5/1982 | Pachmayr et al. | 42/74 |
| 4,638,714 | 1/1987 | Heintz et al. | 89/37.07 |
| 4,716,811 | 1/1988 | Johnson | 89/40.12 |

FOREIGN PATENT DOCUMENTS

| | | | |
|---|---|---|---|
| 1109056 | 6/1961 | Fed. Rep. of Germany | 89/37.05 |
| 1193918 | 11/1959 | France | 285/252 |
| 104816 | 6/1961 | Norway | 89/37.05 |

*Primary Examiner*—Deborah L. Kyle
*Assistant Examiner*—Stephen Johnson
*Attorney, Agent, or Firm*—Lucas & Just

[57] ABSTRACT

A mechanism for holding a barrel in a mortar unit having a ring calibrated in relation to the diameter of the barrel is disclosed. The ring has a tightening mechanism for locking or releasing the ring and the barrel of the mortar. The ring also has a mechanism for avoiding an involuntary release between the barrel and the ring resulting from firing vibrations. Such a mechanism makes it possible to change the firing angle exclusively by manipulating the tightening mechanism without the need for disassembling or handling the ring-barrel assembly.

The tightening mechanism is made up of a shoe guided in the ring and movable radially to the barrel by a cam activated by a tightening lever.

The mechanism for avoiding an involuntary loosening is made of several pressure washers which press against the shoe. They exert a pressure which can be be regulated by a screw. Several springs are mounted in the screws of the pressure washers and counteract the firing vibrations. Several pins are inserted crosswise into the head of the regulating screws and prevent the screw from turning more than 180°.

5 Claims, 1 Drawing Sheet

MECHANISM FOR FASTENING THE BARREL IN A MORTAR UNIT

Basically two methods are currently known for fastening the barrel to the mortar unit by using a ring:

(a) using a tripod. In this case, the barrel can slip freely in the ring;

(b) using a bipod. In this case, the barrel requires a third point of attachment, which is provided by pressing the ring against the barrel.

The present invention relates to a mechanism for fastening the barrel to the mortar unit by using a bipod.

In the current fastening solutions using a bipod, the ring is designed in two half-rings which are pressed against the barrel, with which it is necessary to release the two half-rings whenever it is desired to change the angle of fire. The precision is inadequate, and play affecting the precision of the shot may be developed in time.

To overcome these limitations, the present invention recommends a new mechanism for fastening the barrel to the mortar unit, characterized by the following features:

(a) a ring calibrated in relation to the diameter of the barrel and which encloses same;

(b) tightening means for locking or releasing said ring and the barrel of the mortar;

(c) Means for avoiding an involuntary release between barrel and ring caused by the vibrations of the shot;

so that it is possible to change the firing angle exclusively by handling the tightening means, without a need for disassembling or handling the ring-barrel unit.

It is also characterized by the fact that said fastening means for locking and releasing ring and barrel are:

(a) a shoe guided in said ring and movable radially to the barrel by (b) a cam activated by a pressure layer.

It is also characterized by the fact that said means for avoiding involuntary release between barrel and ring are:

(a) several pressure washers pressed against the shoe by the bearer flange of the cam itself and which exert a pressure on it which can be regulated by means of screws;

(b) several springs mounted in the tightening pressure regulating screws of the pressure washers and which counteract the vibrations of the shot;

(c) several pins inserted crosswise into the head of said regulating screws and which prevent their turning more than 180°.

It is also characterized by the fact that said tightening lever has a locking catch in its closed position - barrel pressed by the shoe.

Figure 1:
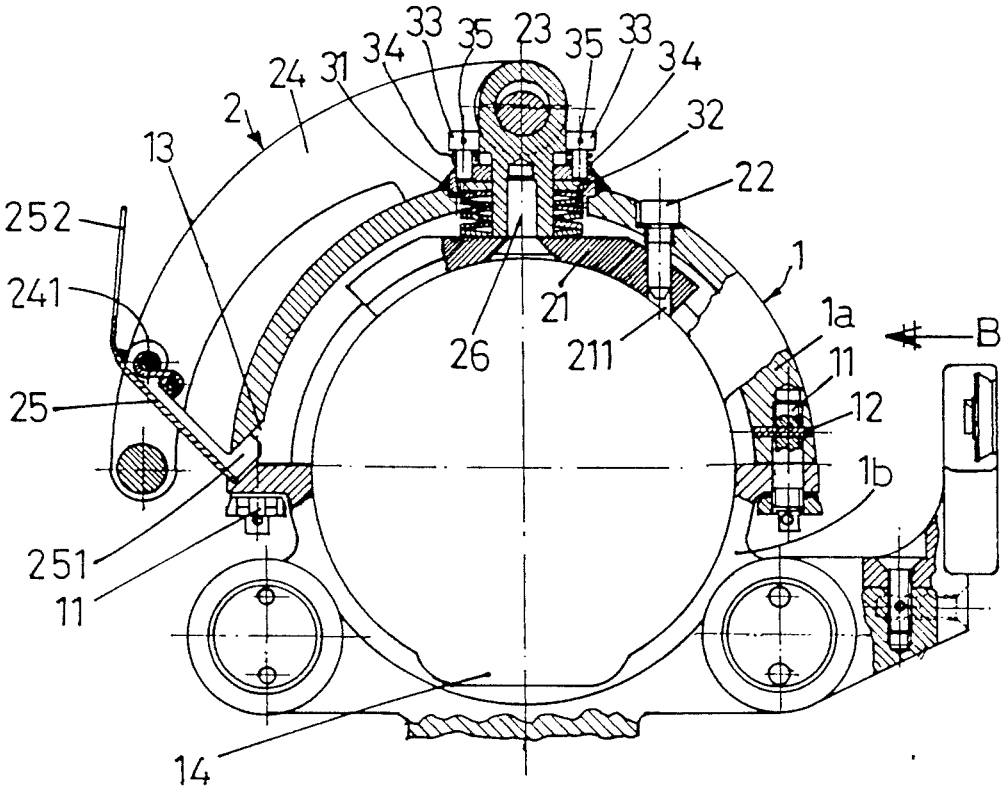

FIG. 1 presents an overall view of the mechanism for fastening the barrel to the mortar unit according to the invention, in partial section for observing its construction features.

Figure 2:
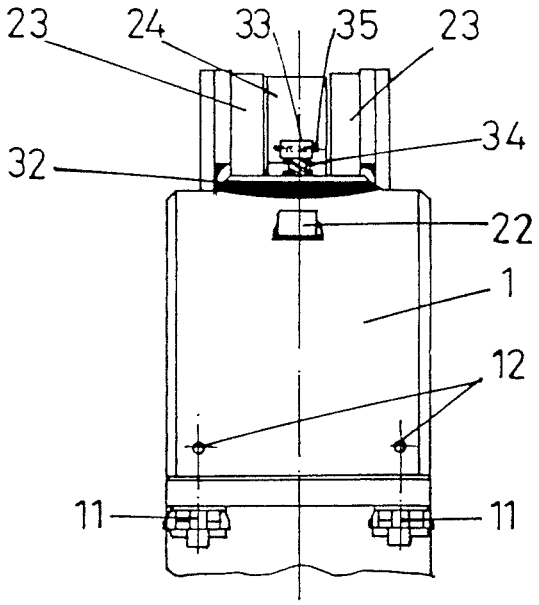

FIG. 2 presents a profile view according to indication B of the foregoing figure.

A nonlimiting practical form of execution example of the present invention is described below. Other forms of execution in which accessory changes which do not depart from its framework are introduced absolutely are not to be excluded; on the contrary, the present invention also includes all its variants.

According to the invention, and in accordance with the form of execution represented, the mechanism for fastening the barrel to the mortar unit consists of:

a ring (1), calibrated with respect to the diameter of the barrel of the mortar;

tightening means (2) for locking and loosening said ring (1) and barrel of the mortar.

Said ring (1) is a closed structure and forms a single block around the barrel of the mortar. It may present a single-piece configuration although, simply because of structural limitations, it especially appears in two parts (1a) (1b) rigidly connected to each other by screws (11) fastened in said ring (1) by several shearing pins (12).

Said ring (1) forms a cavity (13) for anchoring in block position the tightening means (2) described below, and optionally it forms at least one cavity (14) for the purpose of reducing the friction surface between ring (1) and mortar barrel. Said tightening means (2) consist of at least the following elements:

a shoe (21) guided in said ring (1) by several studs (22);

a cam (23) which produces a radial movement of shoe (21) in relation to ring (1);

a tightening lever (24) which acts on said cam (23). Shoe (21) is mounted in cam (23) by at least one screw (26), and it provides several holes (211) for being guided in studs (22) - see FIG. 1.

Tightening lever (24) mounts joined at (241) a catch (25) whose head (251) is lodged in hole (13) of ring (1) in block position or is released from it when activated turning by pressing on its rear arm (252).

Said means for avoiding its involuntary release consist of at least the following elements:

several pressure washers (31) attached to ring (1) by means of flange (32);

several screws (33) regulating the tightening tension of said pressure washers (31);

several springs (34) and some pins (35) mounted in relation to said screws (33).

The pressure washers (31) press shoe (21) against the barrel of the mortar, forming a stop against screws (33) regulating the tension.

Springs (34) counteract the shot vibrations.

Pins (35) prevent the turning of screws (33) by more than 180° for the purpose of avoiding an involuntary loosening.

I claim:

1. A mechanism for fastening a barrel to a mortar unit, the mortar unit being capable of being fired at a firing angle characterized by:

(a) a ring calibrated in relation to the diameter of the barrel and which encloses the barrel;

(b) tightening means for locking and releasing said ring and the barrel of the mortar unit, said tightening means comprising:

(i) a shoe guided in said ring and movable radially to the barrel by (ii) a cam activated by a tightening lever, said cam having a bearer flange, (c) means for avoiding an involuntary release between said barrel and said ring because of shot vibrations, so that it is possible to change the firing angle exclusively by manipulating the tightening means, wherein said means for avoiding an involuntary release between said barrel and said ring comprises:

(i) several pressure washers pressed against the shoe by said bearer flange of the cam and which exert a pressure on said shoe which can be regulated by tension regulating screws;

(ii) several springs mounted in the tension regulating screws of the pressure washers for counteracting shot vibrations;

(iii) several pins inserted crosswise in the head of said tension regulating screws which prevent said tension regulating screws from turning more than 180°.

2. The mechanism for fastening a barrel to a mortar unit in accordance with claim 1 wherein said tightening lever has a locking catch for locking said mechanism in a closed position.

3. The mechanism for fastening a barrel to a mortar unit in accordance with claim 1 wherein the ring has at least one hole to reduce a friction surface of said ring with the barrel of the mortar unit.

4. A mechanism for fastening a barrel to a mortar unit characterized by:

(a) a ring which encloses said barrel;

(b) a shoe situated between said ring and said barrel;

(c) a cam situated on said ring and fixed to said shoe through said ring;

(d) a tightening lever situated exteriorly on said ring acting on said cam for displacing said shoe radially with respect to said barrel;

(e) studs in coaxial holes in said ring and in said shoe for guiding the radial displacement of said shoe.

5. The mechanism of claim 4 wherein said ring is a unitary structure.

* * * * *